United States Patent [19]

Flagg

[11] 4,154,188

[45] May 15, 1979

[54] RECREATIONAL DEVICE

[76] Inventor: Rodger H. Flagg, 1415 Lynn Ave., Ft. Wayne, Ind. 46805

[21] Appl. No.: 700,395

[22] Filed: Jun. 28, 1976

[51] Int. Cl.[2] ..... A63B 35/00

[52] U.S. Cl. ..... 115/20; 115/1 R; 9/310 G; 280/206; 272/115

[58] Field of Search ..... 272/115, 1 B, 1 E; 115/20, 23, 21; 280/206; 9/310 R;310 F;310 G; 11 A;310 C;2 A

[56] References Cited

U.S. PATENT DOCUMENTS

| | | | |
|---|---|---|---|
| 1,973,584 | 9/1934 | Tatter et al. | 9/11 A |
| 3,037,218 | 6/1962 | Brooks | 9/11 A |
| 3,088,732 | 5/1963 | Hetland | 272/1 B |
| 3,620,529 | 11/1971 | Newman | 9/310 F |
| 3,664,290 | 5/1972 | Finn | 272/1 B |
| 3,779,201 | 12/1973 | Spahn | 272/115 |
| 3,934,291 | 1/1976 | Hagen | 272/115 X |

FOREIGN PATENT DOCUMENTS

| | | | |
|---|---|---|---|
| 1974545 | 9/1967 | Fed. Rep. of Germany | 272/1 B |
| 1974544 | 12/1967 | Fed. Rep. of Germany | 272/1 B |
| 2100565 | 7/1972 | Fed. Rep. of Germany | 272/1 B |
| 2050717 | 3/1971 | France | 272/115 |
| 2235713 | 5/1975 | France | 272/1 B |
| 487660 | 3/1970 | Switzerland | 272/1 E |
| 500989 | 2/1939 | United Kingdom | 272/1 B |

*Primary Examiner*—Richard J. Johnson
*Attorney, Agent, or Firm*—John A. Young

[57] ABSTRACT

A recreational device consisting of two annular members and a plurality of circumferentially spaced cross members secured one at each end to the annular members to form a floatation wheel having sufficient buoyancy so that an individual can stand uprightly between the annular members and step from one cross member to the next along land surfaces, marshlands, or a body of water. The device has sufficient buoyancy to support the individual who can transport himself over land, water and other surfaces, such as swamp, muck, salt marshes and the like.

13 Claims, 6 Drawing Figures

RECREATIONAL DEVICE

BACKGROUND OF THE INVENTION

Many recreational devices have been proposed and involve the principle of floatation. These devices, for the main part, however, do not permit a person to be supported within a floatation device and to quite literally walk across the surface of a body of water while at the same time having full view of where the device is going.

Another problem is that floatation devices, particularly those for children, require a high degree of balance and skill to mount the device, principally because of the inherent instability of some forms of floating objects.

Therefore, one of the important objects of the present invention is to construct a floatable recreational device which is designed to have sufficient buoyancy and stability to support a person within the device and which can be readily entered and maneuvered.

An important feature of the present invention is that an individual can readily hoist himself into the device and become buoyant thereby and then transport himself via walking action within the device and with good visibility in the direction of movement and a good view of the surroundings at the front, side and back of the device, thus contributing to the safety and recreational value of the device.

Another important feature of the present invention is to reduce the wind resistance by allowing the wind to circulate freely between the cross members and the annular members, thus enabling this recreational device to be used on windy days as well as calm days.

A further object of this invention is to develop agility, skill and coordination in its user by efficiently pacing his steps in coordination with the rotation of the cross members to achieve a continuation of movement. Further, competitive racing of this invention would require a high degree of coordination as well as strength and endurance, and could be accomplished over a variety of terrain.

Another important features of the present invention lies in the unique fastening arrangement of the cross members, whereby the cross members can be selectively arranged around the periphery of the annular members so that the relative spacing can be varied to suit the user. For example, for young classes of users, the spacing will be relatively closer and for older users, the spacing can be varied to meet their individual requirements.

DETAILED DESCRIPTION OF THE INVENTION

Figure 1:
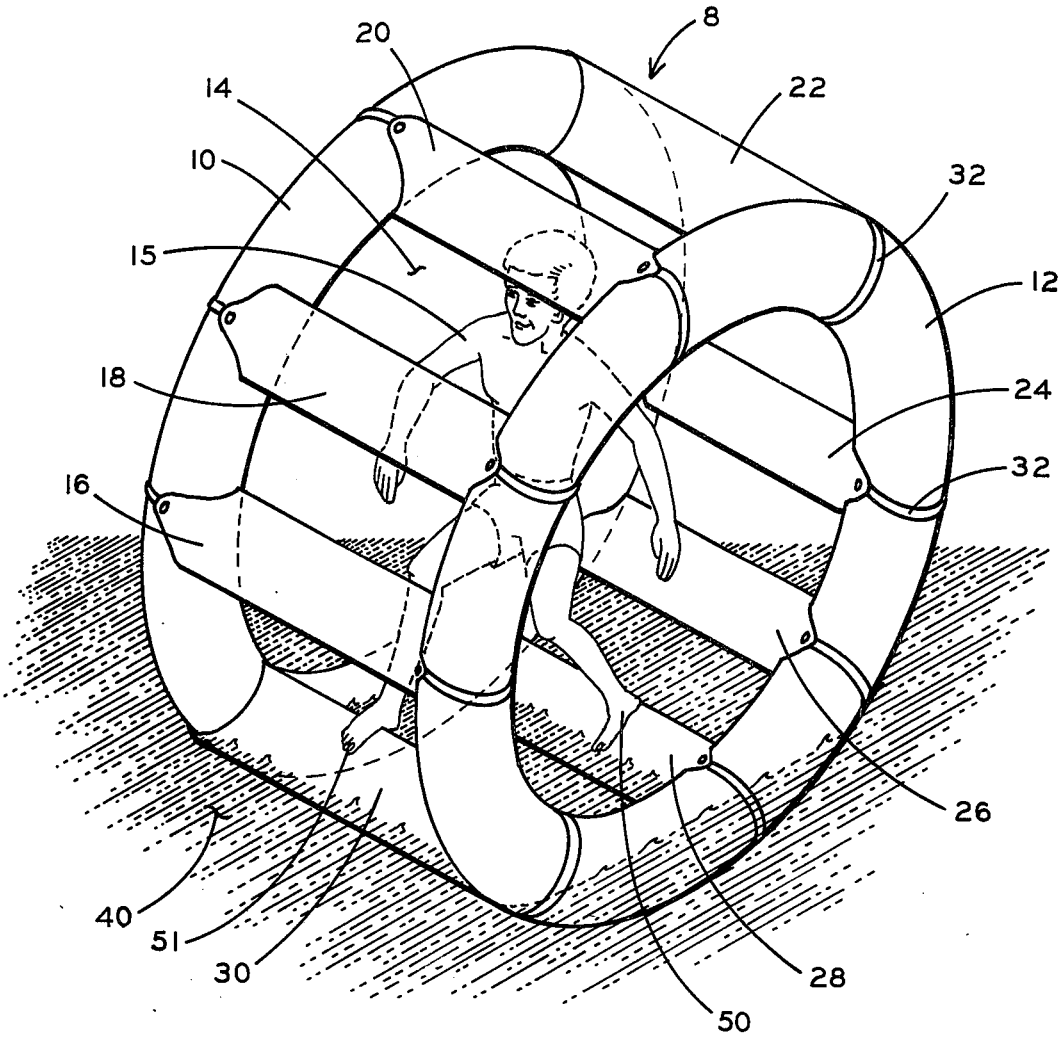
FIG. 1 is a perspective view of the device showing an occupant therein.

The device, designated generally by reference numeral 8, consists of two annular side members 10 and 12 defining an envelope 14 which is proportioned to receive an individual 15 in upright position between side members 10 and 12. Side members 10 and 12 are annular buoyant or inflatable members consisting typically of plastic or rubber composition, the device being inflated through a suitable valve mechanism (not shown). Extending between annular side members 10 and 12 are a series of circumferentially spaced buoyant or inflatable elements 16–30 which are regularly spaced apart and are secured at opposite ends thereof to the annular members 10 and 12 respectively, whereby they are held in the operative positions shown in FIGS. 1 and 2.

These elements 16–30 are typically secured by bands 32 which permit the members of 16–30 to flex slightly in the middle while still maintaining their respective circumferential positions on the annular members 10, 12. The members or elements 16–30 are may be individually inflated and may be of the same or different composition as annular members 10, 12, i.e. rubber, plastic expanded styrofoam, or the like and the elements 16–30 are inflated by means of a conventional valve, such as used in air mattresses or the like (not shown). A typical dimension for the annular members 10, 12 is approximately 16" in cross sectional diameter and an 8–12' overall diameter. A typical dimension for the cross members is that each is 16" in diameter and approximately 3' in length. By lengthening the cross member 16–30, the device can accommodate more than one person. Thus, an individual 15, by using both arms and legs, can balance himself in a stable position within the device using any two adjacent ones of the elements (for example 28, 30) partially submerged. The water displacement of 28 and 30, together with displacement of chordal sections of annular members 10 and 12 will provide buoyancy to support the individual. Also, there is enough buoyancy of the device as shown in FIG. 1 to hold the occupant in a relatively stable position, even in choppy waters.

The individual 15 can literally "walk" by placing first one foot 50 and then the other 51 on successive ones of the elements 16–30 thereby causing rotation of the device and advancing it over the surface of the water 40. In this way, the user "walks" on the surface of the water from one location to the next and the space between adjoining or adjacent elements 16–30 permits a view forwardly and backwardly of the device 8.

The occupant is enabled to move from one location to the next while having a full view to the front and back of the device, that is in line with the movement of the device enabling a substantial safety factor in that the individual has a full view of the conditions on the water surface and can avoid any hazards.

Other means for securing the transverse elements 16–30 to the annular elements 10, 12 and which are contemplated as within the scope of the present invention include making such elements stitched, glued, sealed, formed integrally with, etc., or secured by snap fasteners or straps, all of these expedients being deemed to be within the scope of the present invention and intended to be covered within the purview of the following claims.

Figure 3:
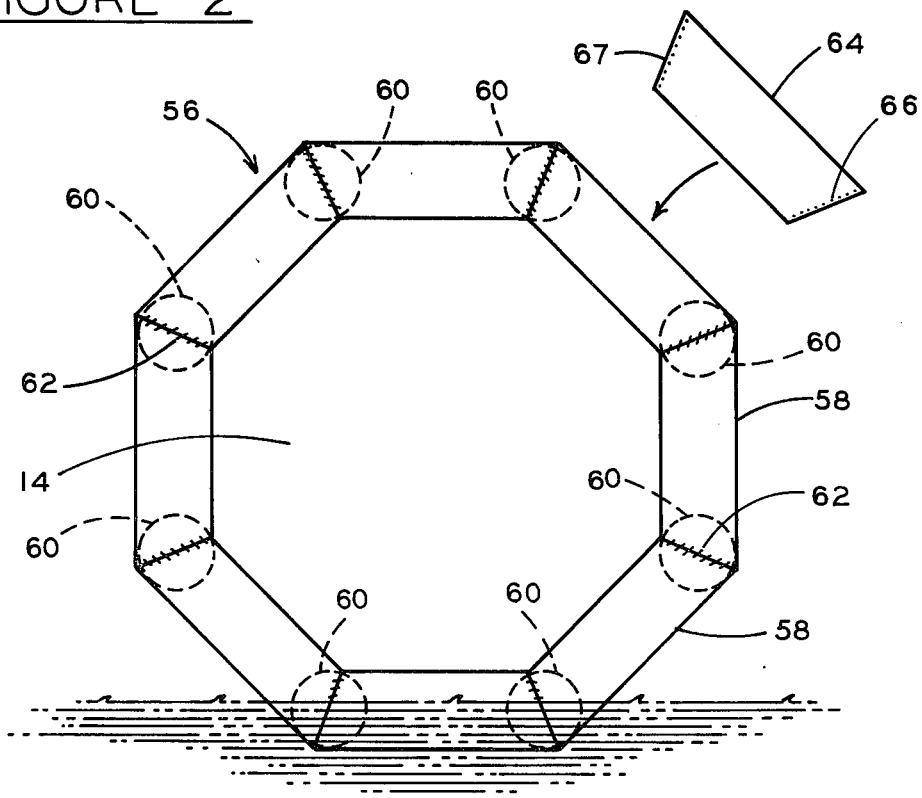
FIG. 3 is a side elevation view of a further embodiment of the invention, showing in exploded view, a portion of the annular member.

Referring next to the embodiment shown in FIG. 3, there is indicated an annular ring 56 consisting of sections 58 which are joined end-to-end and, where butted together, include cross members 60. The ends of section 58 are joined by stitching 62, one of the sections 64 being shown removed in FIG. 3. The stitching is passed through openings 66, a plurality of which are found along the edges 67.

Figure 2:
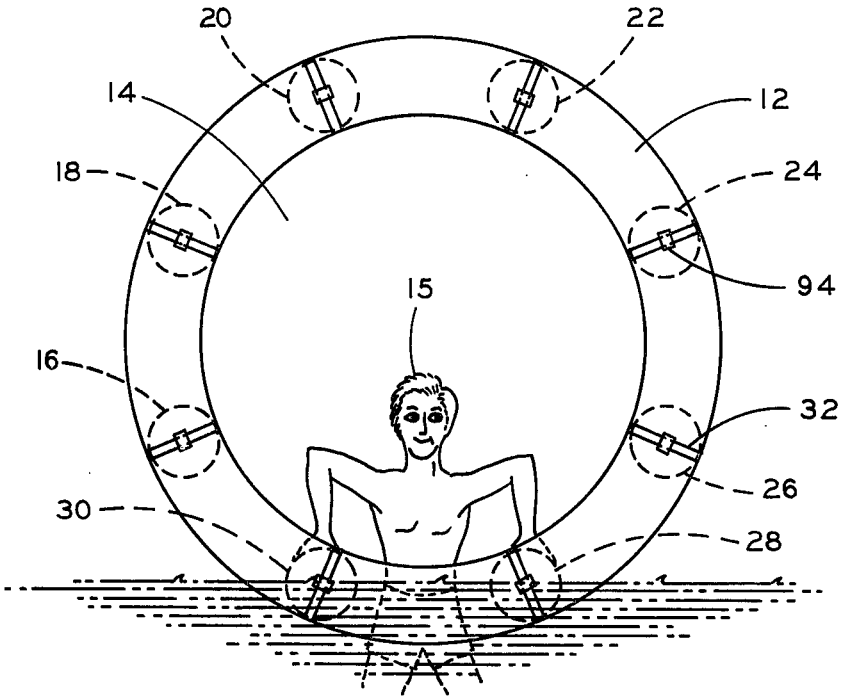
FIG. 2 is a side elevation view showing the occupant entering between the cross members.

In all other respects, the embodiment is the same as in the previously described embodiments of FIGS. 1 and 2.

Figure 4:
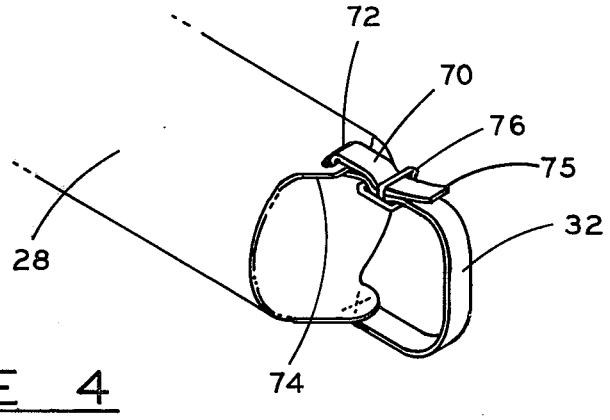
FIGS. 4, 5 and 6 are perspective views showing several means of attaching the cross members to the annular members.
Figure 5:
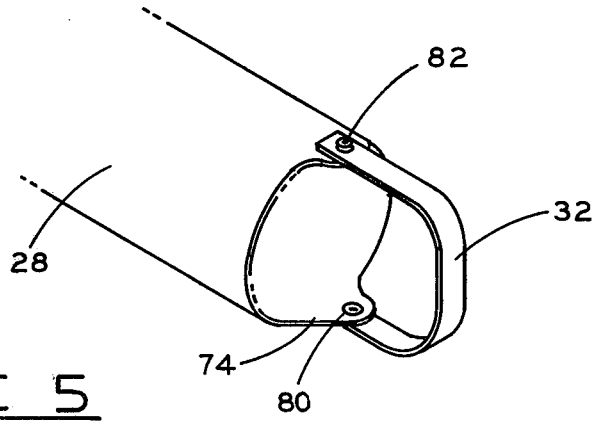
Figure 6:
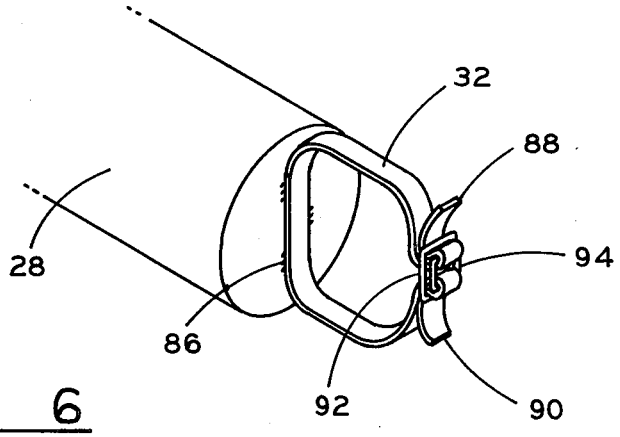

Referring next to FIGS. 4, 5 and 6, there are illustrated alternative ways of attaching the transverse element to the annular sides 10, 12. In these additional embodiments, FIG. 4, one of the transverse elements (in this case 28) is shown including end flaps or extensions 74 with slots 72 adapted to receive ends 75 of the strap 32. End 70 then passes through slot 72, such end then being passed through a buckle 76.

In the embodiment shown in FIG. 5, the strap 32 includes a snap fastener 82 which connects with a complementary snap fastener 80 received in end 74 so that each snap fastener 82, one at each end of the strap 32, is complementarily secured to coacting fastener 80 in each of the ends 74 and thereby securing the transverse element 28 to the annular members 10 and 12.

In the embodiment shown in FIG. 6, strap 32 is secured at its mid-portion to the end of the transverse element 28 and the ends 88, 90 are passed through buckles 92, 94, doubled over, and cinched to the buckle, creating the necessary tension to effect attachment to the annular members.

These are a few of the selected embodiments available for attaching the transverse elements 16–30 to the annular members 10, 12.

OPERATION OF THE INVENTION

In operation, in the preferred embodiment the annular elements 10 and 12 and the transverse elements 16–30 are individually inflated and either starting from the shoreline or within the water the individual 15 enters the interior of the device in the manner shown in FIGS. 1 and 2.

One of the important advantages of the present invention is, as shown in FIG. 2, the individual 15 can obtain entry to the space between the sides 10, 12 by diving to a lower level and then entering between adjacent ones of 16–30, using the adjoining one of the transverse elements as support by which the person raises himself and then enters into the walking position in FIG. 1. By literally stepping or walking from one adjacent cross element to the next in the manner shown in FIG. 1 the device is rolled in the water, the water remaining on the surfsce and providing sufficient buoyancy for the occupant and in this way transport is obtained across the surface of the water.

When the element is unused, the annular and cross elements are deflated and readily packaged within a small space for storage and overland transportation.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims.

What I claim is:

1. A recreational device comprising a pair of annular floatable ring members of generally circular cross-section providing buoyancy and adapted to be disposed in upright positions during use, a plurality of circumferentially spaced-apart flotation elements extending between and attached at opposite respective ends one to each of said annular members and with the flotation elements having a cross-sectional diameter substantially equal to the cross-sectional diameter of the annular floatable ring members, the aggregate spaces between the flotation elements providing the user within the device a relatively unobstructed view of the direction and course of said device, the spacing of the flotation elements being proportioned to permit user entry from beneath the water level upward between said flotation elements and into the interior of said device, the flotation elements forming partially submersible treads for a human occupant's pacing movement within the device, said flotation elements producing incremental advancements by sequentially trapping surface water between successive elements and said annular members, the total submerged volume for flotation being provided by a combination of said floatable annular members and said flotation elements whereby rolling action of said device produces an advancing movement through the water as the flotation elements successively turn to come into contact with the water, are partially submerged, and thereafter reemerge.

2. The recreational device in accordance with claim 1 wherein said annular members and cross members consist of expanded styrofoam composition.

3. The recreational device in accordance with claim 1 wherein said annular members are formed of a plurality of rectilinear elements joined end-to-end in a polygon circular shape.

4. The recreational device in accordance with claim 1 wherein said annular members are composed of end-to-end modular portions in which not less than three portions are joined to form respective floatable annular members.

5. The recreational device as described in claim 1 wherein the flotation elements are spaced sufficiently apart to allow the user to enter the recreational device while in the water, between the flotation elements, regardless of rotational position of the recreational device; the flotation elements providing a stable means of support on each side of the user as he enters the recreational device from the water.

6. The recreational device as described in claim 1 including strapping means for attaching the flotation elements at the ends thereof to the spaced annular members to allow flexibility in the flotation elements which are held at variably selected uniform intervals about the circumference of the annular members to provide the user with a variety of spacing distances, suitable to the user's needs.

7. A recreational device in accordance with claim 1 wherein the flotation elements and annular members include at least one air valve for inflating the interior of flotation elements and annular members, said air valve being located in non-interfering relation with the footing of the user as the user steps from flotation element to flotation element.

8. The recreational device as described in claim 1 wherein the area between the flotation elements is greater than the combined areas of the flotation elements, so that winds travel around and through the flotation elements with a minimum of resistance, making progress on water against moderate winds, possible.

9. The recreational device in accordance with claim 1 in which the device is directionally oriented for movement along a line parallel to the planes, including said annular members.

10. The recreational device in accordance with claim 1 in which said flotation elements include strapping means forming a flexible articulated connection between each of the respective ends of said flotation element and its associated annular member.

11. A recreational device as described in claim 1, whereby more than one user may jointly cross a body of water by coordinating pacing and stepping actions from flotation element to flotation element.

12. A method employing the construction of claim 1 for traversing the surface of water by means of a walking motion which imparts motive power to said endlessly rotatable device, comprising the steps of:

(a) continuously stepping from one to the next of said circumferentially spaced flotation elements which serve as treads which are sufficiently spaced apart to provide access to the interior of the rotatable device therethrough, and to effect continuous rotation of the device by successively bringing each cross-section flotation element in turn into descending relation against the surface of the water where it becomes partially submerged and then emerges with such action taking place continuously;

(b) trapping a quantity of surface water between simultaneously partially submerged elements to form a "biting" surface which serves as a reaction for the device as it traverses across the water surface; and, (c) tracking the device from one angular position to the next by a successive series of increments defined by each area of entrapped fluid whereby the device progresses across the water surface to the accompaniment of rotation effected by the treadle action of the user stepping from one flotation element to the next.

13. A method employing the construction of claim 1 of traversing a user over a surface of water by means of said endlessly rotatably cylindrical support having circumferentially spaced flotation elements, which are sufficiently spaced apart in a circumferential sense to provide an aggregate of open spaces greater than the spaces represented by flotation elements to provide a relatively unimpeded view of the course and direction of movement by the user, comprising the steps of:

(a) stepping upon successive raised flotation elements to cause their partial immersion in water;

(b) shifting the user's weight forward as a result of stepping from one flotation element to the next flotation element;

(c) trapping water between partially submerged flotation elements; and, (d) continuing to effect rotation by means of stepping and shifting the user's weight and trapping water between flotation elements, whereby the user is carried across the water surface.

* * * * *